US006319144B1

(12) United States Patent
Hasty

(10) Patent No.: US 6,319,144 B1
(45) Date of Patent: Nov. 20, 2001

(54) BILLIARD BOWLING GAME

(76) Inventor: Vernon Hasty, 2015 Spalding Dr., Holdredge, NE (US) 68949-1033

( * ) Notice: Subject to any disclaimer, the term of this patent is extended or adjusted under 35 U.S.C. 154(b) by 0 days.

(21) Appl. No.: 09/432,556

(22) Filed: Nov. 3, 1999

(51) Int. Cl.[7] ..... A63D 1/02; A63D 3/00

(52) U.S. Cl. ..... 473/115; 473/116; 473/106; 473/595; 273/118 R; 273/129 Q

(58) Field of Search ..... 473/115, 116, 473/117, 42, 595, 107; 273/126 R, 236, 126 A, 129 L, 118 R, 127 B, 120 R, 120 A, 129 Q, 108, 108.1, 127 C

(56) References Cited

U.S. PATENT DOCUMENTS 706,925 * 8/1902 Gibson .
712,722 * 11/1902 Robbins .
2,490,288 * 12/1949 Wickersham .
3,602,507 * 8/1971 Naylor .
3,764,136 * 10/1973 Breslow .
3,880,425 * 4/1975 Kintz .
3,888,483 * 6/1975 Adickes .
5,183,261 * 2/1993 Nobi .
5,358,448 * 10/1994 Stephens .
5,540,624 * 7/1996 Hixson .
5,655,768 * 8/1997 Moret .
5,772,204 * 6/1998 Phelps .

* cited by examiner

*Primary Examiner*—Sebastiano Passaniti
(74) *Attorney, Agent, or Firm*—Mills Law Firm PLLC

(57) ABSTRACT

This invention is a table type game that requires both billiard skills and bowling skills to play. Scaled down bowling lanes, gutters, pins and approach are provided. The scaled down bowling balls are regulation size billiard balls that are struck and driven by regulation size billiard cues. The approach is covered with a billiard table type felt material and is raised approximately ¼ inch above the lane to allow the billiard balls to replicate the sounds of a bowling alley during play. Standard bowling scoring is used.

11 Claims, 21 Drawing Sheets

BILLIARD BOWLING GAME

BACKGROUND OF INVENTION

1. Field of Invention

This invention related to table type games and, more particularly, to a game that utilizes both billiard skills and bowling skills.

2. Description of Prior Art

Table type games have been popular over the years and have encompassed everything from shuffle board type games to pin ball devices and more recently times various and sundry arcade type games, a majority of the same being electronically controlled.

Bowling is a very popular sport and, although it can be year round, organized bowling leagues have traditionally followed a fall/winter schedule because the indoor setting is unaffected by inclement weather.

With bowling leagues being disbanded during the summer and with many bowling alleys actually being closed during this time, bowling enthusiasts must seek other recreational activities. The game of billiards is played on billiard tables in recreation rooms of homes as well as in billiard parlors. Although great skill is required to play billiards, it is not generally an organized sport with leagues involving large numbers of people including a spectator following.

Concise Explanation of References

Other than bowling and billiards referred to above, there is no known prior art references.

BRIEF DESCRIPTION OF INVENTION

After much research and study into the above mentioned problems, the present invention has been developed to provide a table type game that can be played year-round and utilizes the skills required of both bowlers and billiard players. Leagues can be organized in playing of the present billiard bowling game and it lends itself to being a spectator sport. It is a game that can be enjoyed by people of all ages and can be played year-round.

The above is accomplished by providing a table bowling alley that is $\frac{1}{4}^{th}$ scale of a regular bowling alley with the bowling pins and balls also being $\frac{1}{4}^{th}$ scale.

The ball is not rolled as in bowling, but is struck with a pool cue in the same manner as playing billiards. Weight can be added to the ball to make it curve as in bowling. The approach area where the ball is struck with a cue is elevated approximately $\frac{1}{4}^{th}$ of an inch so when the ball lands on the lane it sounds like regular bowling.

The lanes are constructed of wood and are finished in the same manner as regular bowling lanes.

Although single lane systems can be produced, the game is preferably constructed in units, for instance, with two lanes. Additional two lane units can be set up with a space therebetween for cues rack.

The present game includes pin spotters and pin setting equipment as in bowling and regular bowling scoring is used. Pin spotters can either be manually operated or automatic, again as in standard bowling.

Seating for ten people can be provided behind each unit and leagues formed in the same manner as bowling leagues.

In view of the above, it is an object of the present invention to provide a hybrid table game that requires the skill of both billiard and bowling.

Another object of the present invention is to provide a billiard bowling game that replicates the sound of a bowling ball on the lane and striking of pins.

Another object of the present invention is to provide a game played with a billiard ball and cue that uses regular bowling scoring.

Another object of the present invention is to provide a one quarter scale bowling lane down which billiard balls are driven by billiard cues.

Another object of the present invention is to provide a table billiard bowling game wherein the pin spotters are manually operated.

Another object of the present invention is to provide a table billiard bowling game wherein the pin spotters are automatically operated.

Other objects and advantages of the present invention will become apparent and obvious from a study of the following description and the accompanying drawings which are merely illustrative of such invention.

BRIEF DESCRIPTION OF DRAWINGS

FIGS. 7*aa*, 7*ba* and 7*ca* is a cutaway rear perspective view of the sweep operation shown in FIGS. 7*a* through 7*c*;

DETAILED DESCRIPTION OF INVENTION

Figure 1:
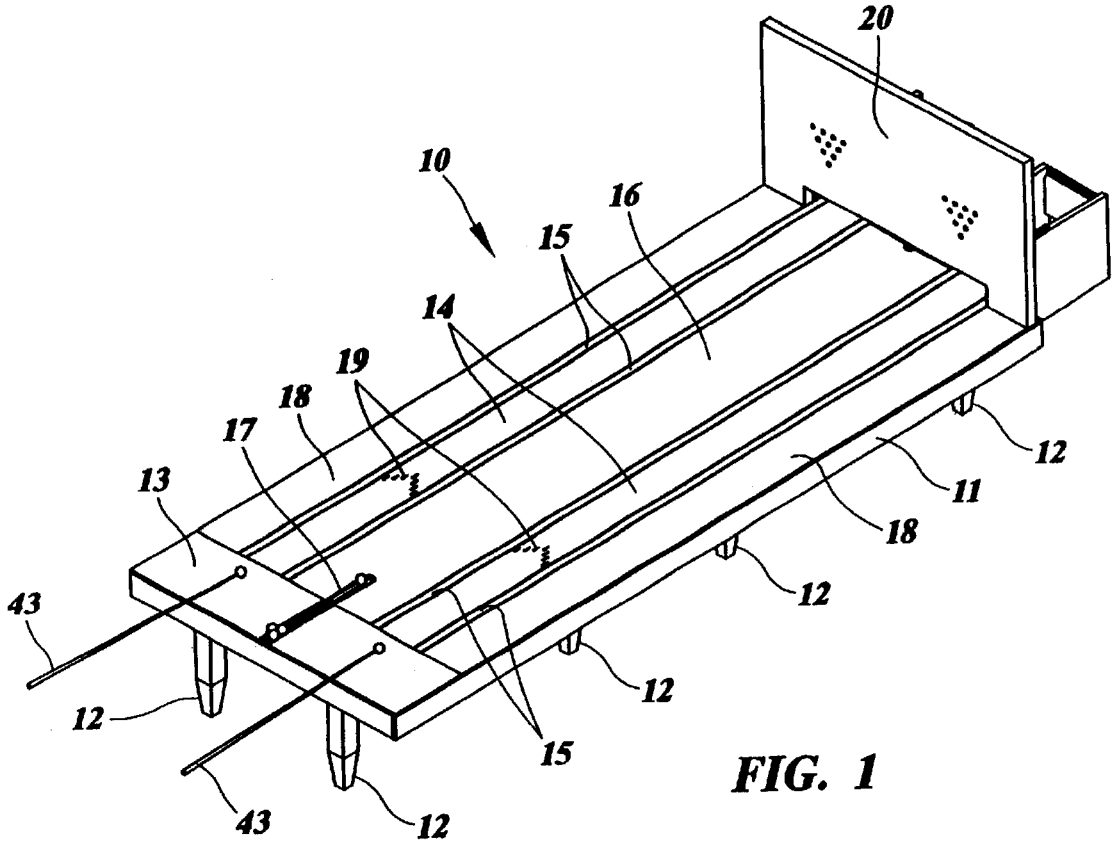
FIG. 1 is a perspective view of a two lane billiard bowling game unit.
Figure 2:
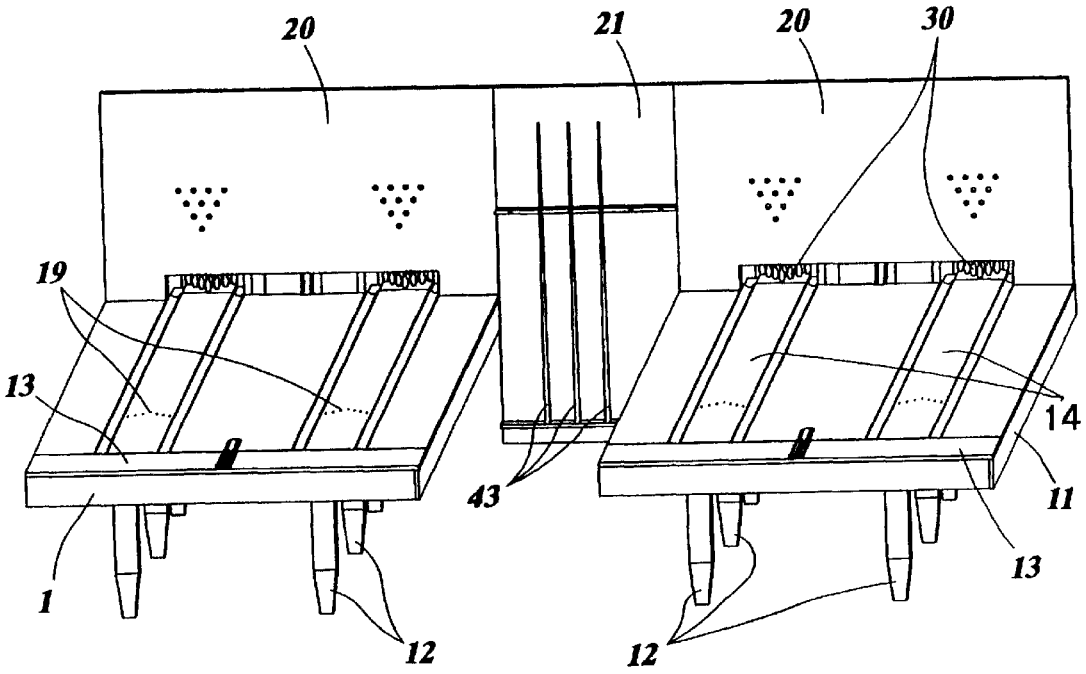
FIG. 2 is a perspective view of the present invention having the unit with a space therebetween for a cue rack.

The table billiard bowling game of the present invention, indicated generally at 10, includes a table 11 that serves as the foundation for the game and has a plurality of depending legs 11. These legs are securely fastened to the bottom of the table but are preferably removable to facilitate transport, since removal leg securing means are well known to those skilled in the art, further detailed discussion of the same is not deemed necessary.

The billiard bowling game mounted on table 11 and includes an approach 13 having a billiard type felt surface. This felt covered approach 13 at the foul line indicia is approximately $\frac{1}{4}^{th}$ of an inch above the surface of the adjacent lane 14. When the billiard ball is shot with the billiard cue, it will become airborne prior to landing on the lane which creates the sound of a regular bowling ball landing on its respective lane.

A pair of parallel longitudinal lanes 14 are constructed of bowling lane hardwood and are covered with bowling lane surface finish. Since hardwood bowling lanes and the finish thereon are well known to those skilled in the art, further detailed discussion of the same is not deemed necessary.

On opposite sides of each of the lanes 14 are gutters 15 of the same proportionate size as bowling lane gutters.

Figure 3:
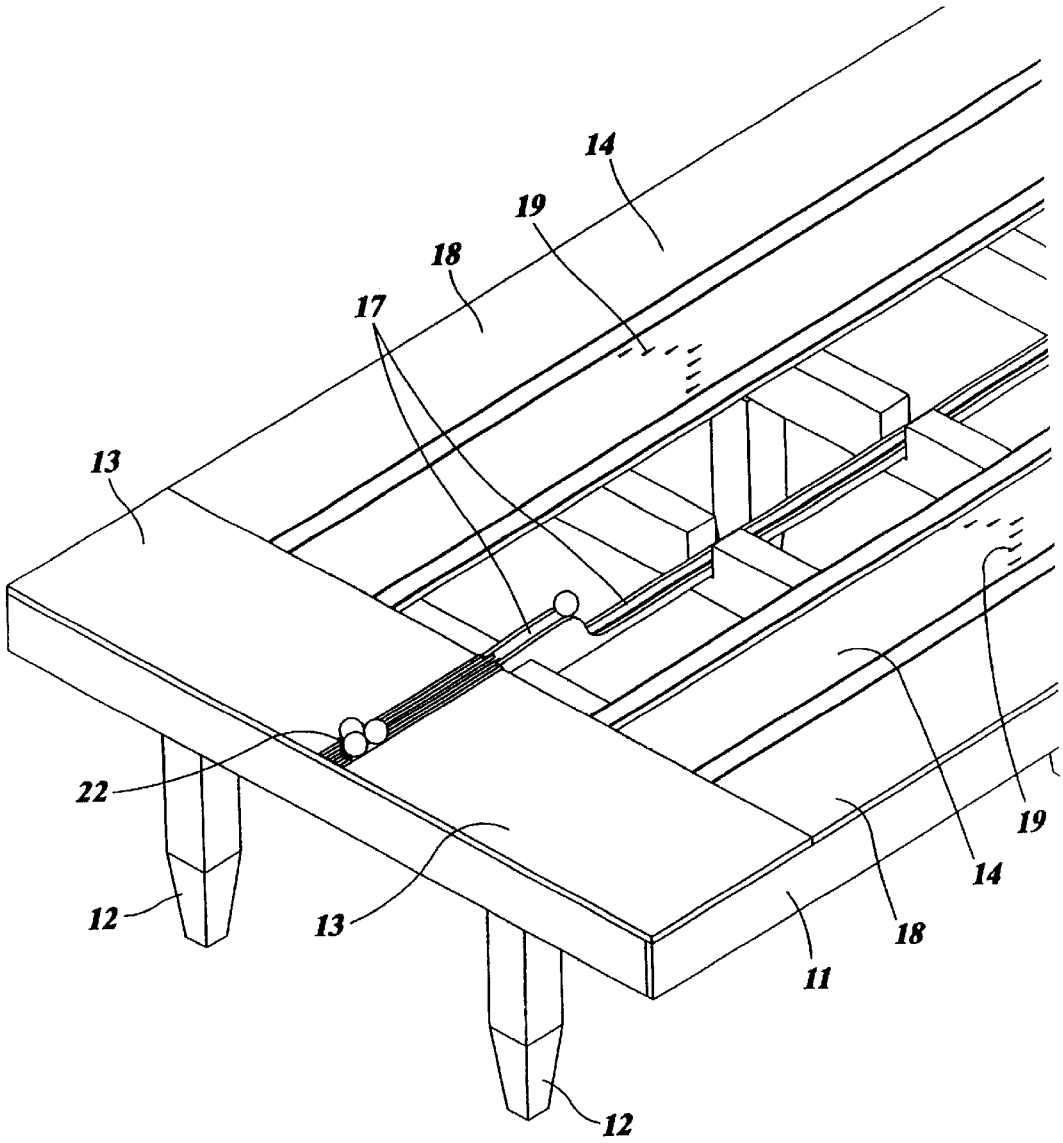
FIG. 3 is an enlarged cutaway perspective view of the ball return and felt surface at the approach.
Figure 4:
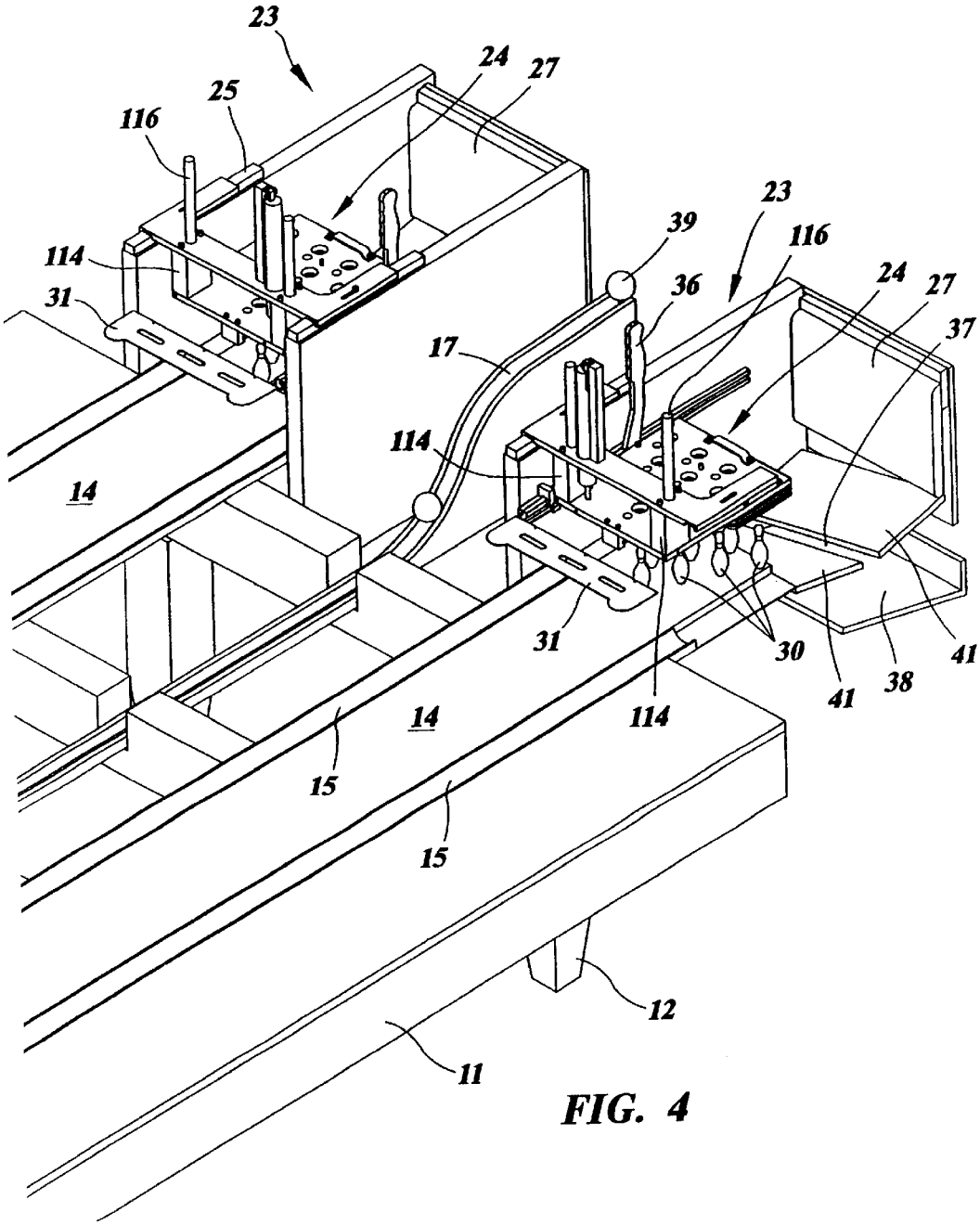
FIG. 4 is a front cutaway perspective view of the ball return and pin spotters.

A center cover is provided between the lanes 14 with a ball return track 17 operatively mounted thereunder as clearly shown in FIG. 3.

On the outside of each of the lanes 14 is an extended longitudinal surface 18.

Conventional bowling alley indicia including a foul line, adjacent alignment dots, lane arrows 19 and the like are all included in bowling lane proportions on the lanes 14. Since these are regulation indicia, further detailed discussion of the same is not deemed necessary.

Behind the masking unit 20 is pin spotting equipment, indicated generally at 23. As with bowling alleys, this equipment can be either manually operated or automated.

The pin spotting equipment 23 includes a re-setter, indicated generally 24 that is operatively mounted on track 25 for longitudinal movement from a position over pin locator dots 26 to a position adjacent back pad 27.

Figure 8A:
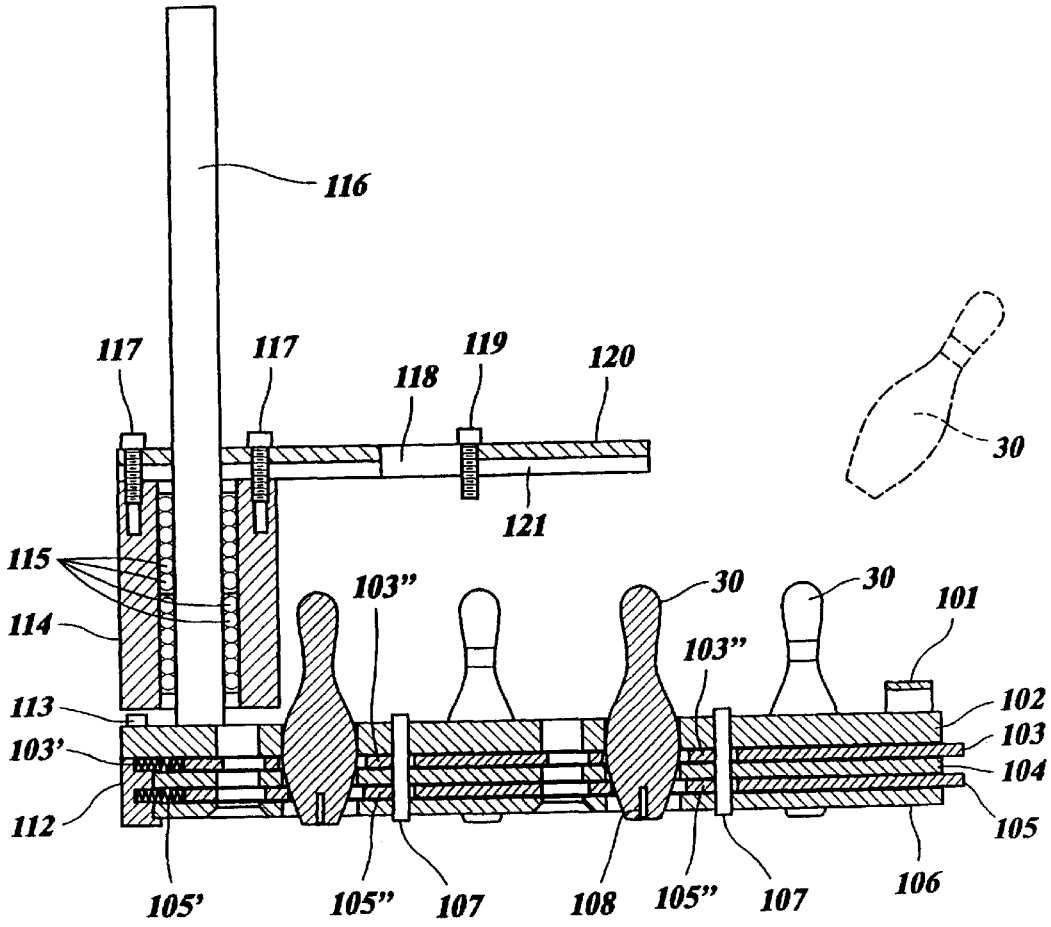
FIGS. 8*a*, 8*b*, 8*c* and 8*d* illustrate the re-setter loading the pins.
Figure 8B:
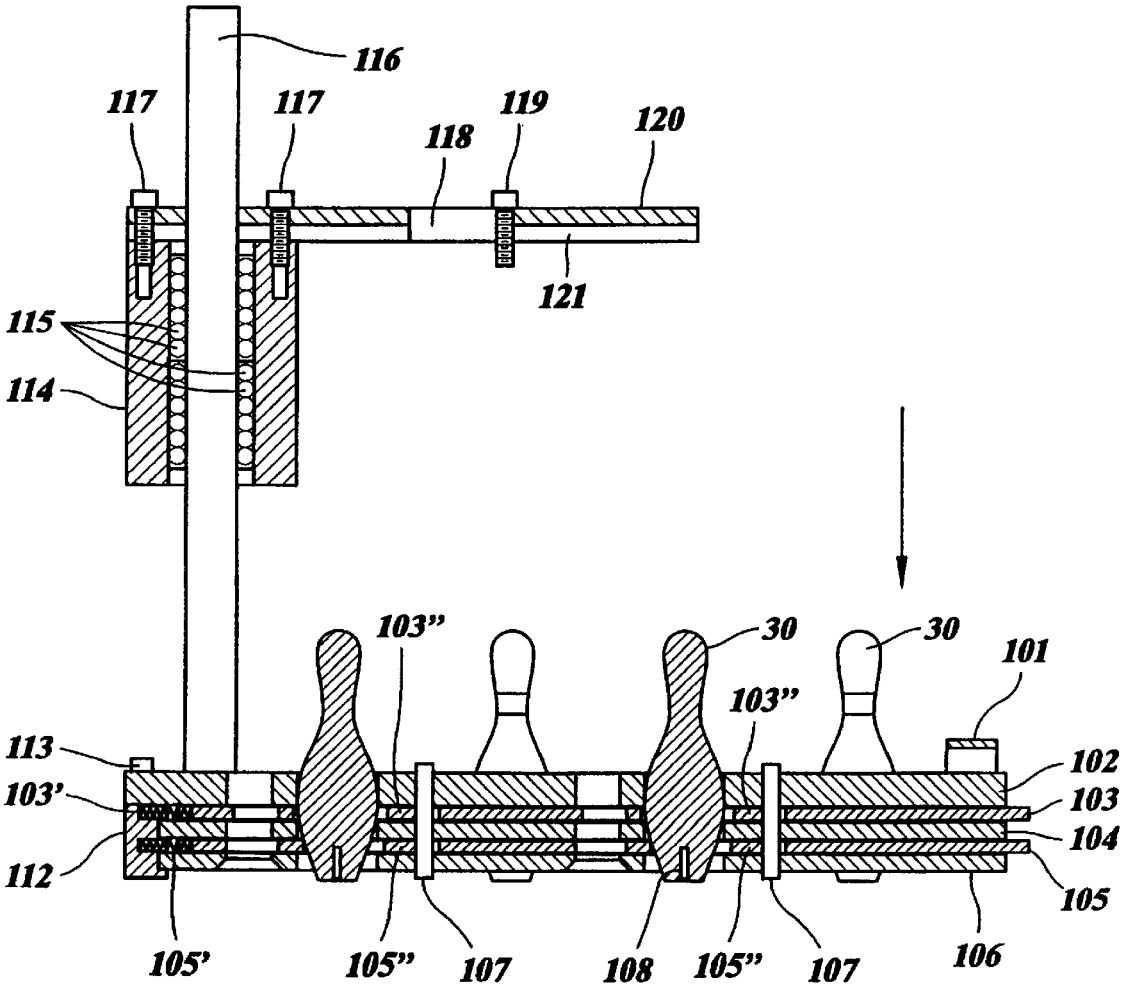
Figure 8C:
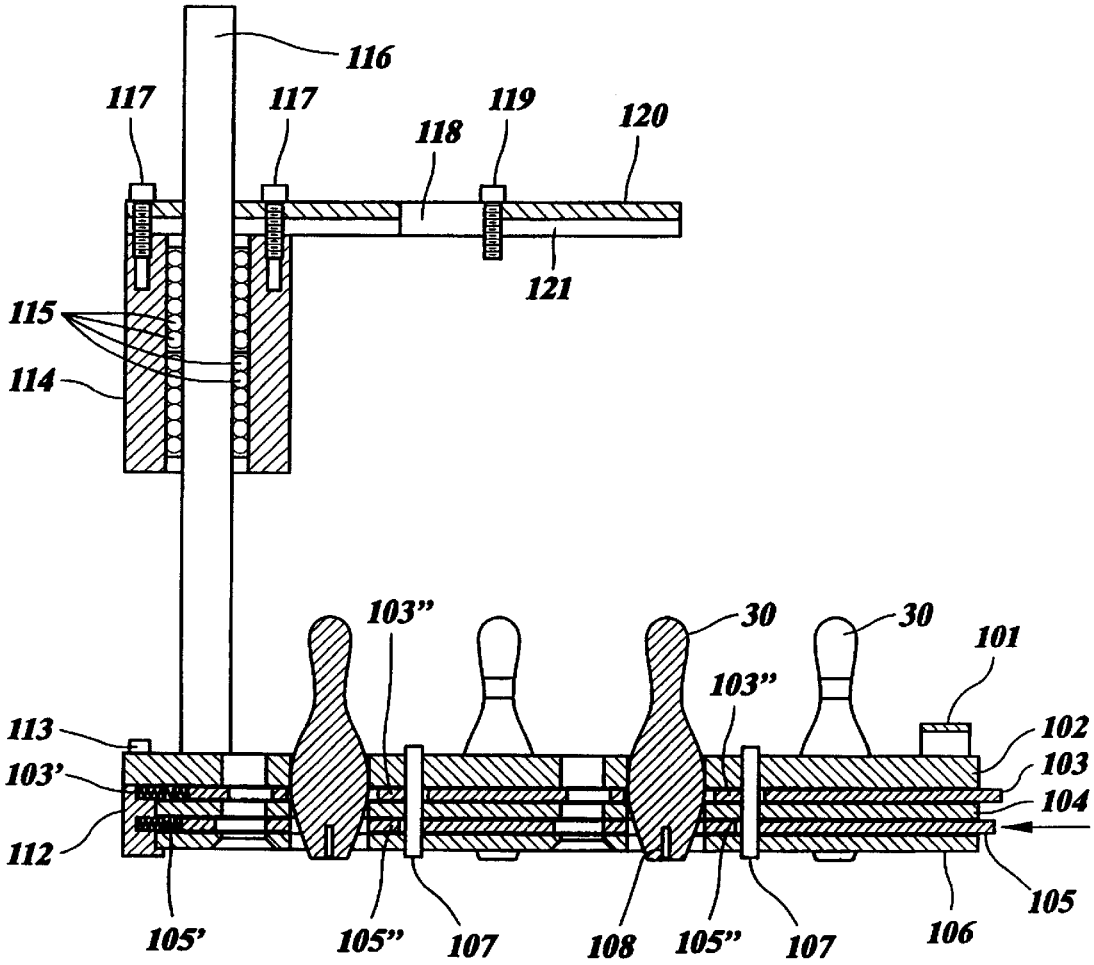
Figure 8D:
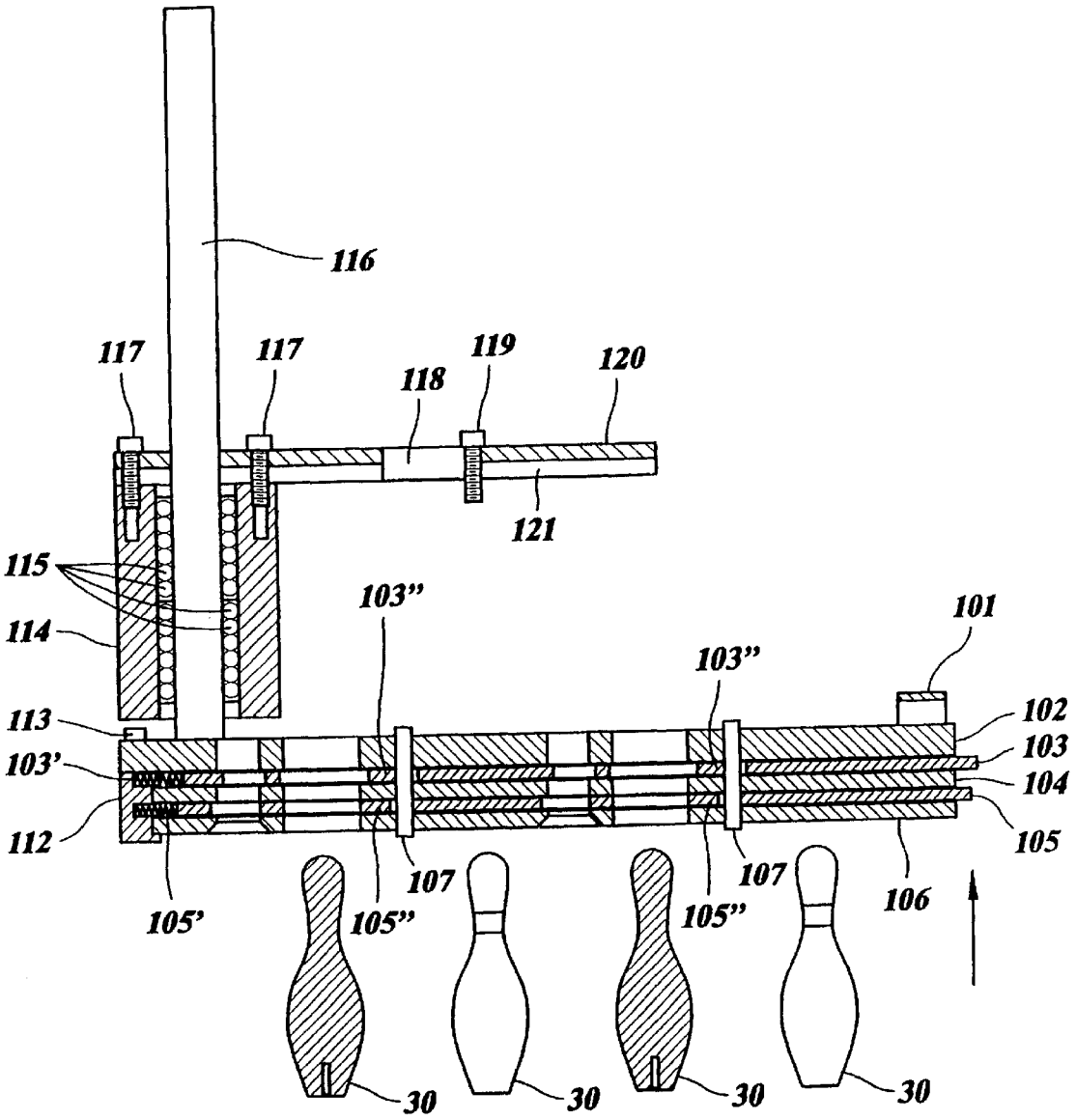

Shaft 28 mounts bearing block 29 which allows the re-setter 24 to move up and down during setting of the pins 30 as shown in FIGS. 8*c* and 8*d* as well as collecting standing pins as shown in FIGS. 9*a*, 9*b*, 9*c*, 9*d* and 9*e*.

A sweep 31 is mounted on the track 32 and includes a pivot 33 operatively associated with pivot block 34. A handle 36 is used to move the sweep longitudinally along track 32 from the position shown in FIG. 7*a* to the position shown in 7*b* with the sweep disposed downwardly to completion of the sweep as shown in FIG. 7*c*. A magnet 35 holds the sweep in the downward position. A storm door closure 37 is operatively connected to the re-setter 24 and is used to retract the re-setter.

The back pad 27 is hingedly mounted at its top as indicated at 27' with an impact absorbing spring 27" and bumper 27'" on the lower edge of such back pad as clearly shown in 7*a*, 7*b* and 7*c*.

Figure 7A:
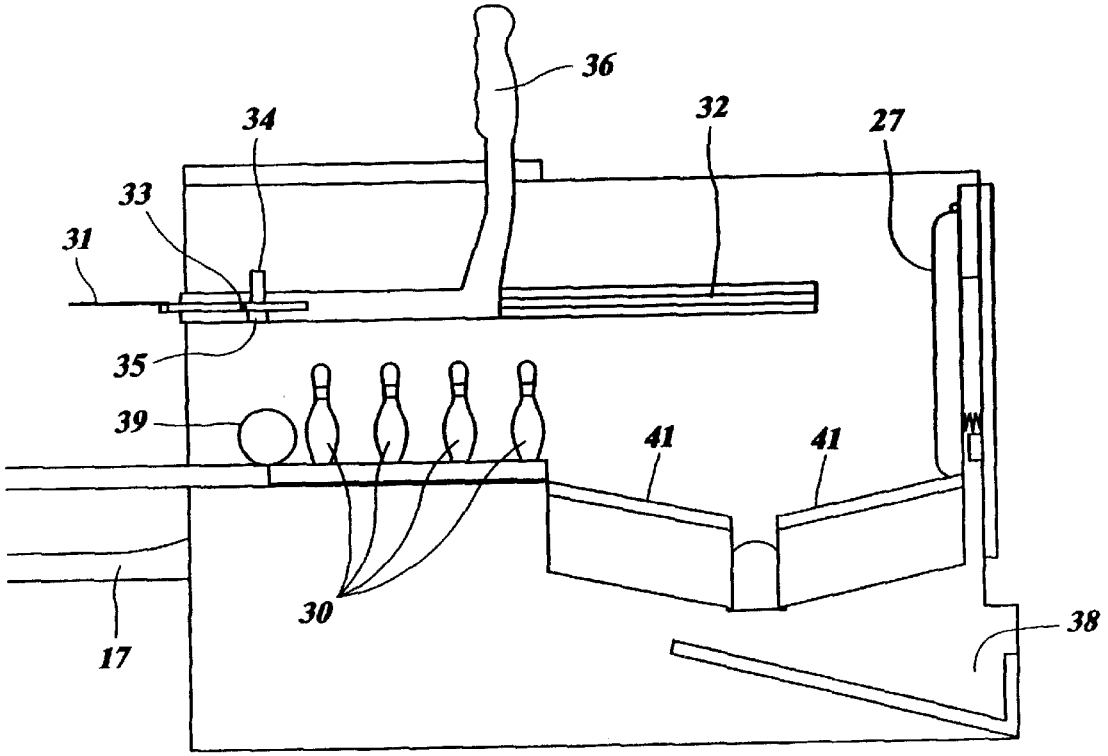
FIGS. 7*a*, 7*b* and 7*c* is a cutaway sectional view illustrated the operation of sweep after the billiard ball strikes the pins.
Figure 7A:
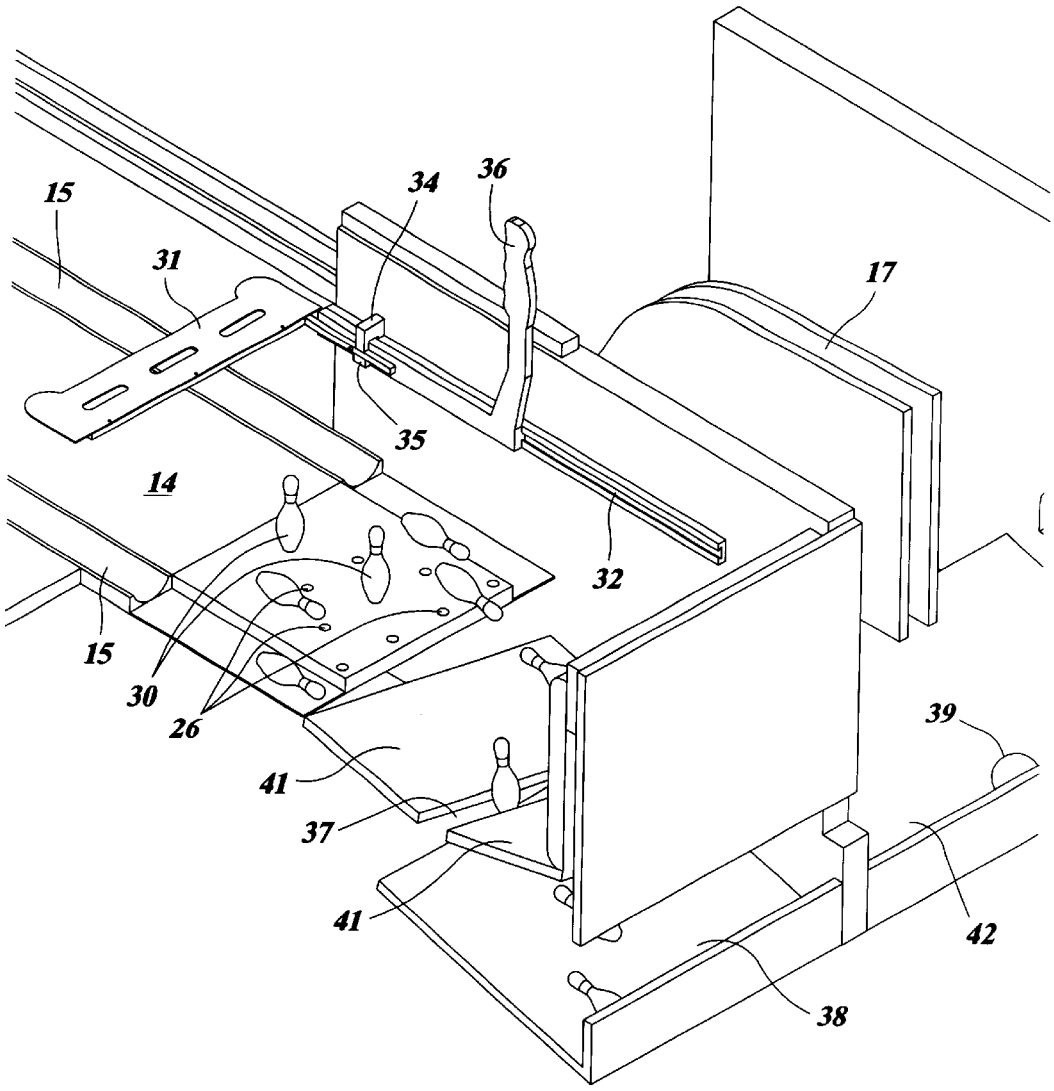
Figure 7B:
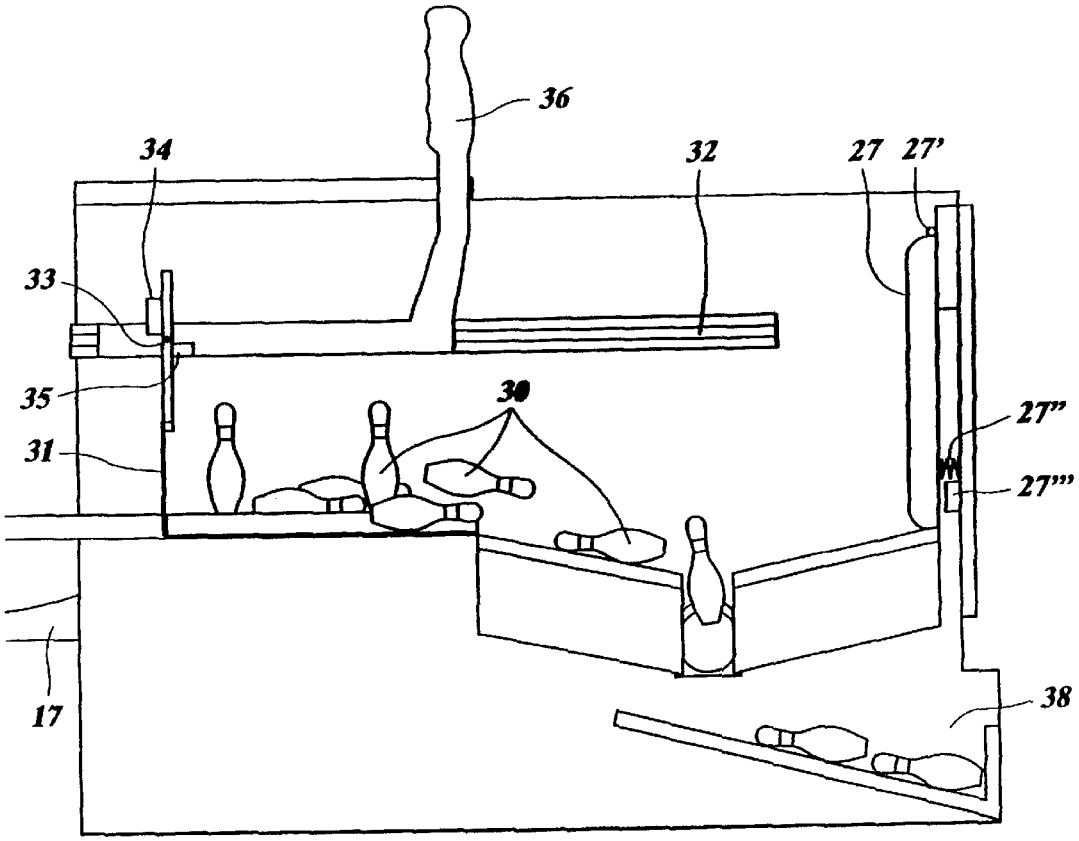
Figure 7B:
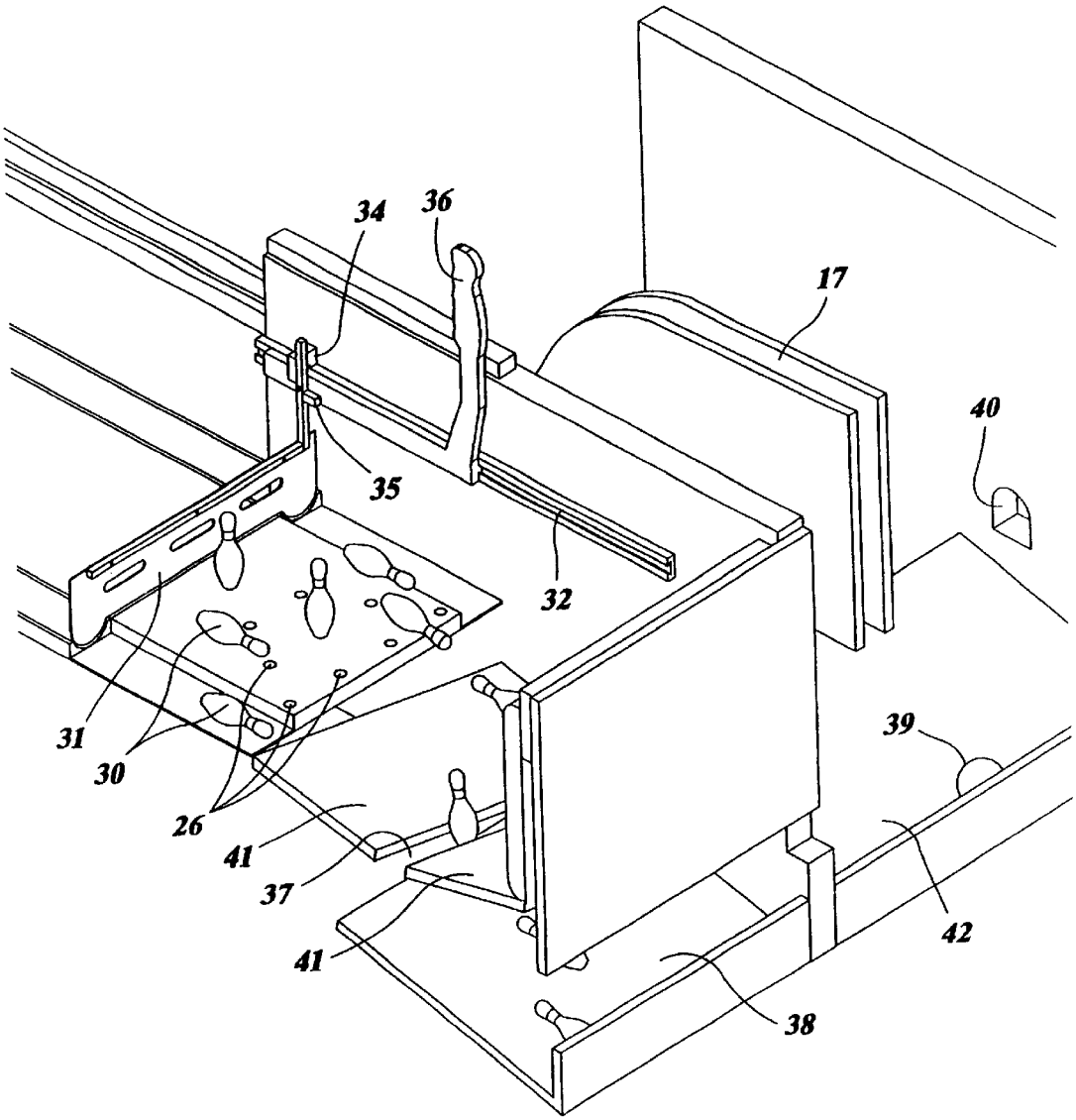
Figure 7C:
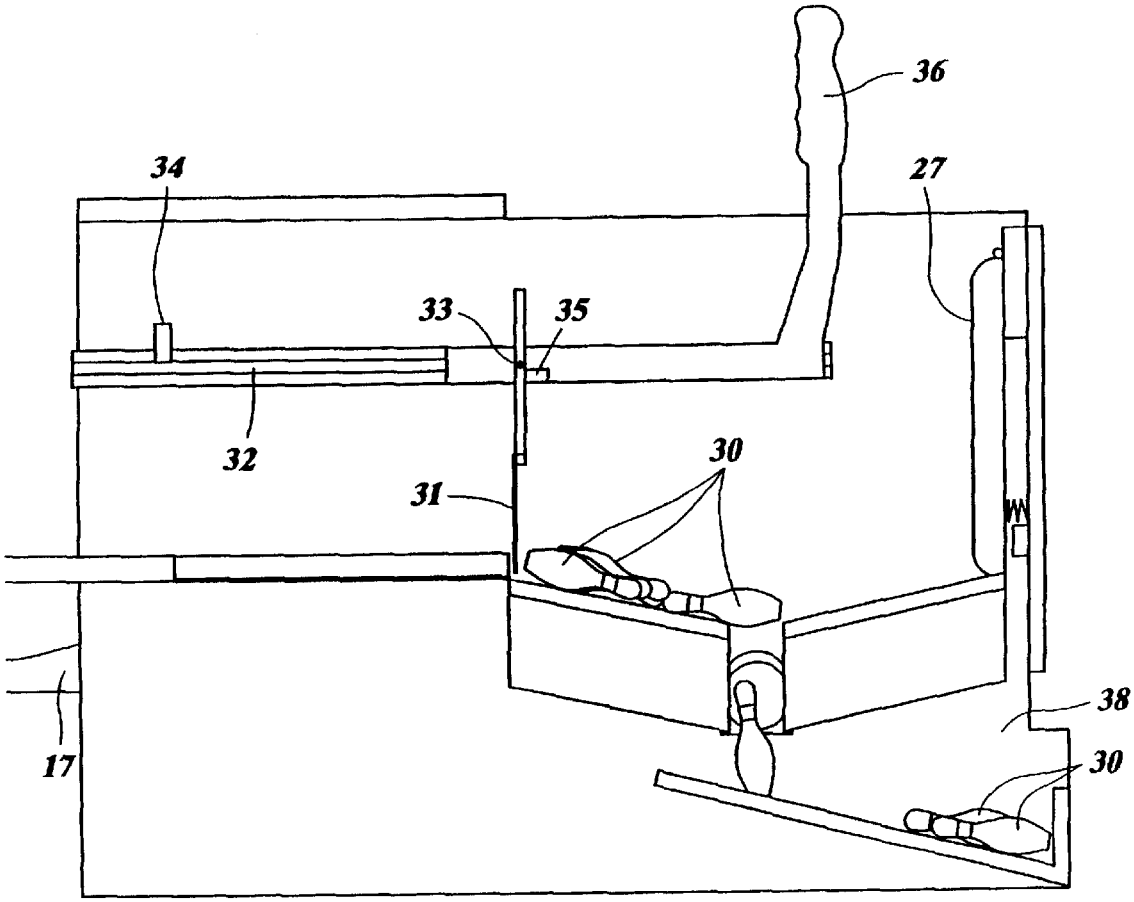
Figure 7C:
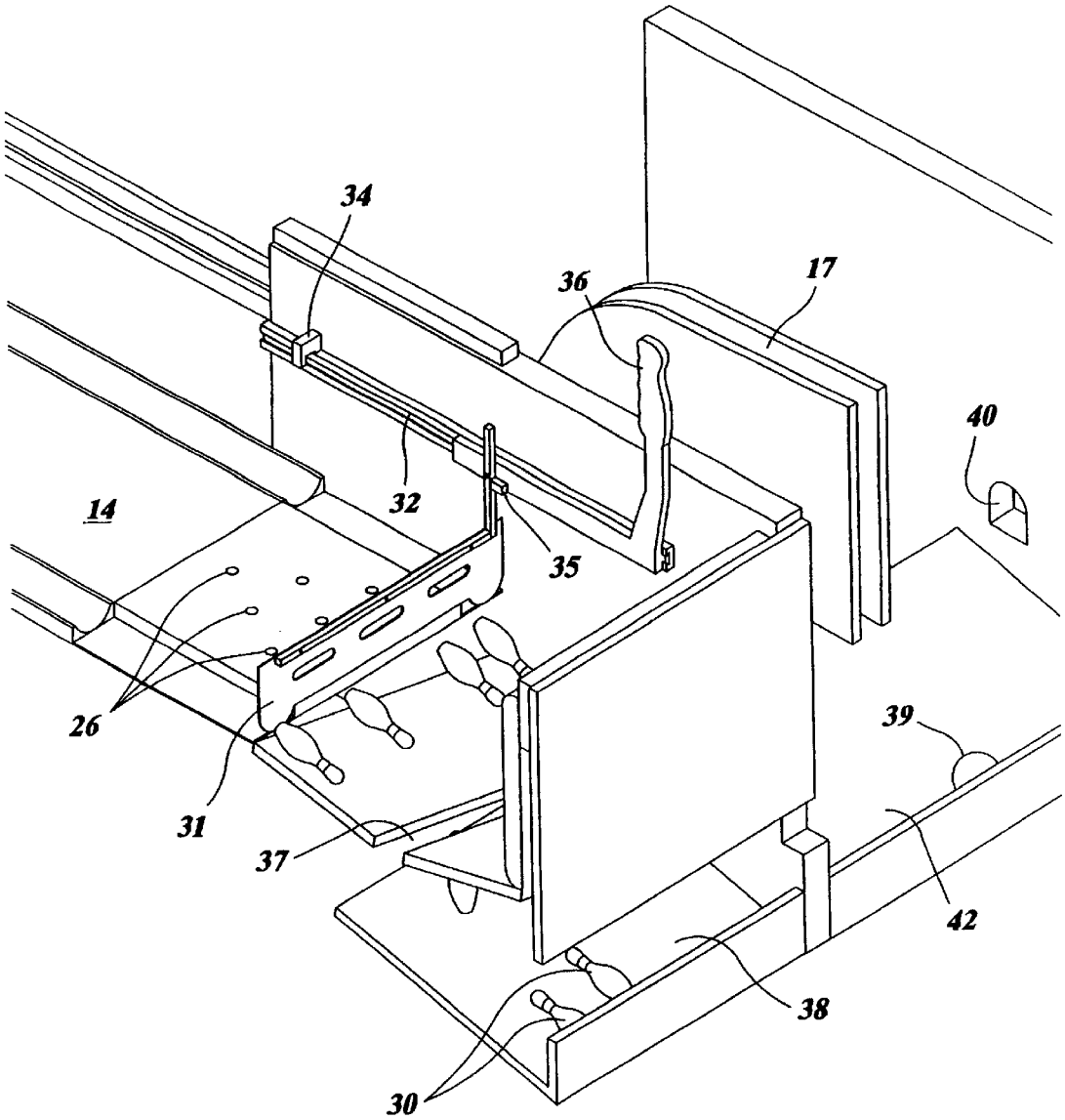

FIG. 7*a* shows the sweep 31 up with the billiard ball 39 moving toward the set pins 30. FIG. 7*b* shows the position of the pins after play with the sweep pivoted downwardly. FIG. 7*c* shows the sweep moved rearwardly to deposit all of the pins 30 on the sloped panels 41 on either side of the pin opening 37 so that such pins can fall to the pin return area 38.

FIG. 7*aa* is a cutaway perspective view showing the position of the sweep 31 during play.

FIG. 7*ba* is a cutaway perspective view of FIG. 7*b* and FIG. 7*ca* is a cutaway perspective view of 7*c*.

Figure 5:
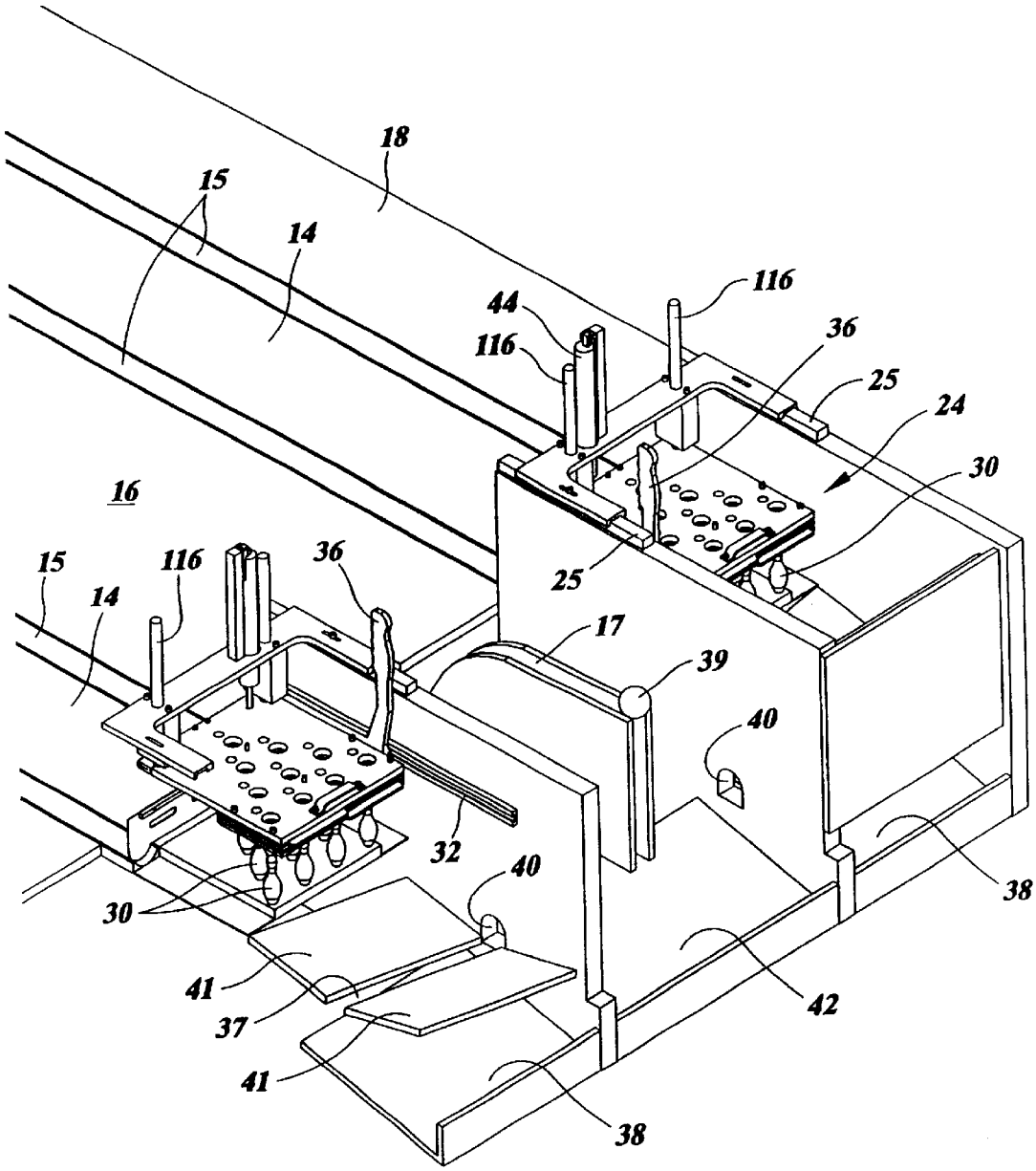
FIG. 5 is a cutaway rear perspective view of the ball return and pin spotters.
Figure 6A:
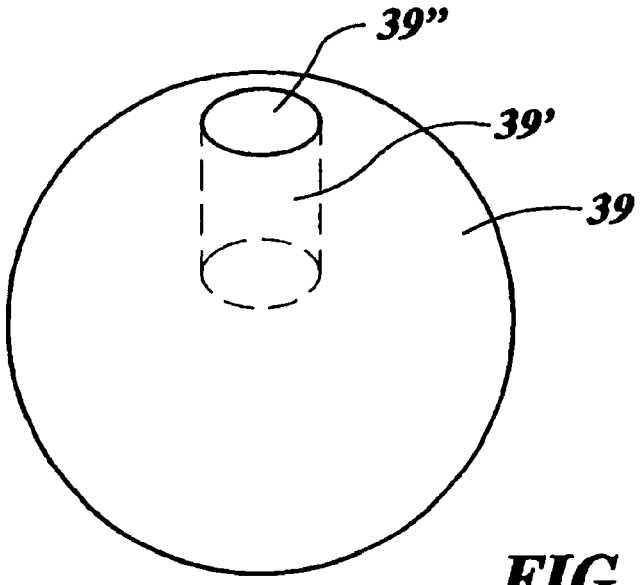
FIGS. 6*a* and 6*b* illustrate a weight added to a billiard ball to make it curve as in bowling.
Figure 6B:
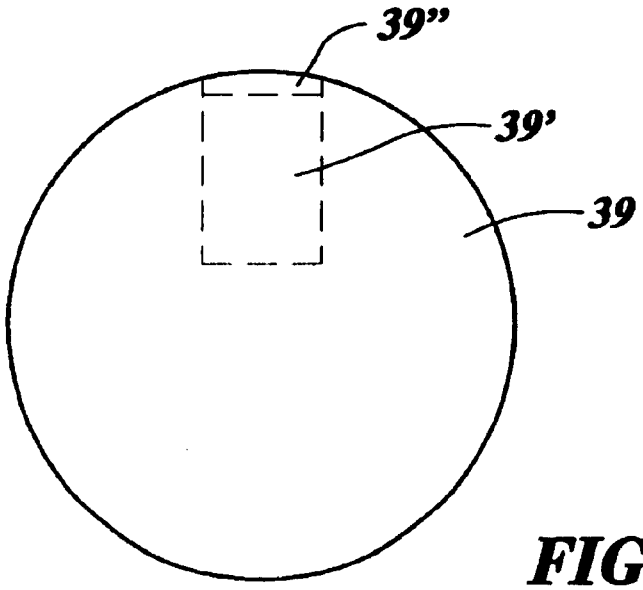

Once the sweep 31 has removed the pins standing and fallen from the area of the pin location dots 26, they fall through opening 37 between sloped panels 111 and will by gravity slide into the sloped pin return area 38 as shown in FIGS. 7*b* and 7*c*. The billiard balls 39 will pass through ball return opening 40 due to the slope of panels 41 and will roll to the ball return area 42 as can clearly be seen in FIG. 5.

Now referring to sectional views of the re-setter 24 shown in FIGS. 8*a* through 8*d* and 9*a* through 9*e*, the functional part the shaft 116 mounts bearing block 114 for vertical movement up and down on bearings 115.

Bolts 117 secure the top side plate 120 to bearing block 114.

A vertical opening 118 is provided in slide plate 120 for movement from full set to spare position with bolt 119 acting as a stop.

Slide portion 121 of slide plate 120 operatively engages re-setter track 25.

A handle 101 is mounted on top plate 102 with spare release plate 103 slidingly mounted thereunder. A fixed center plate 104 is provided between movable spare release plate 103 and movable full set release plate 105. A fixed bottom plate 106 is mounted below full set release plate 105. The spare release plate 103 and the full set release plate 105 are biased by plate spring 103' and 105'.

Vertical locating pins 107 are provided to allow the plates 103 and 105 to move a limited distance in plate slots 103" and 105" against the bias of respective springs 103' and 105'.

End block 112 fixedly mounts top plate 102, center plate 104 and bottom plate 106 which are securely held in place by bolts 113.

Each of the pins 30 have a weight 108 installed in the bottom thereof to give the pins more stability.

FIG. 8*a* shows the re-setter 24 in up, load position with the pins being manually loaded therein. FIG. 8*b* shows the re-setter in lowered position. FIG. 8*c* shows the full set release plate biased to compress spring 105' to align the openings in the top plate 102, the spare release plate 103, the center plate 104, full set release plate 105 and the bottom plate 106 to release the pins and dispose the same on pin location dots 26 of lane 14.

FIG. 8*d* shows the re-setter 24 raised after the pins have been set and the game is ready to play.

Figure 9A:
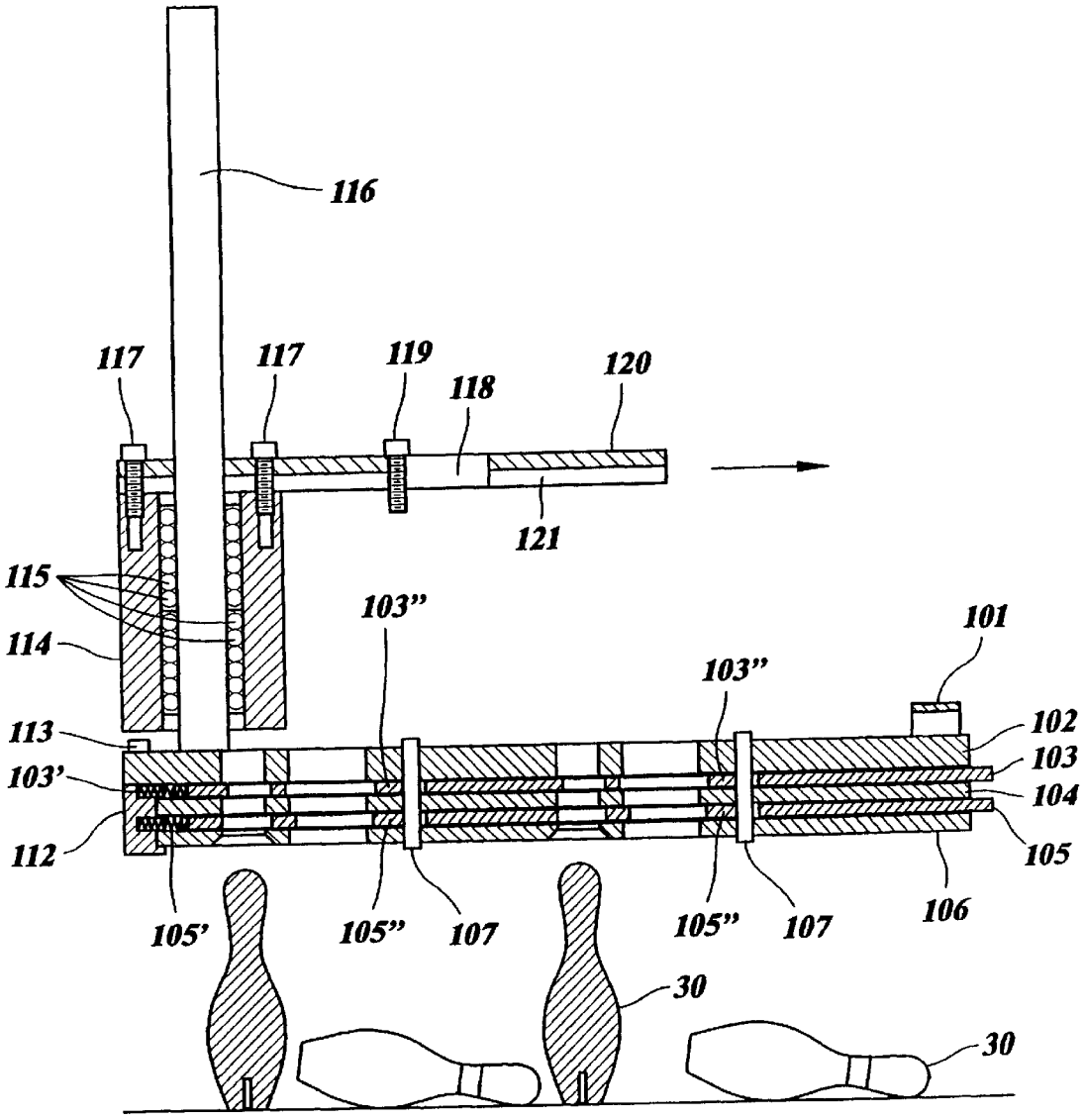
FIGS. 9*a*, 9*b*, 9*c*, 9*d* and 9*e* illustrate the sequence of removing fallen pins and resetting standing pins.
Figure 9B:
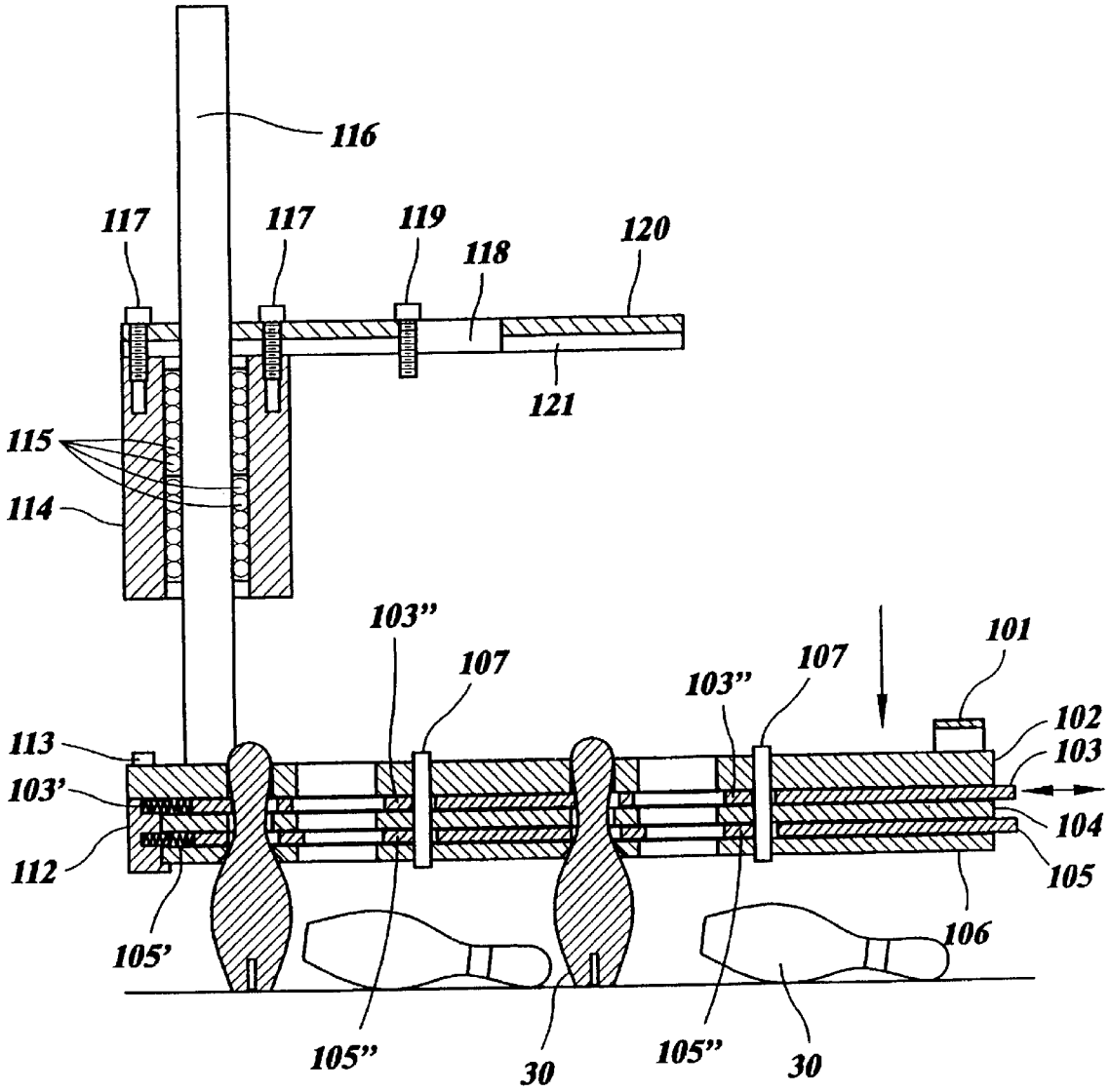
Figure 9C:
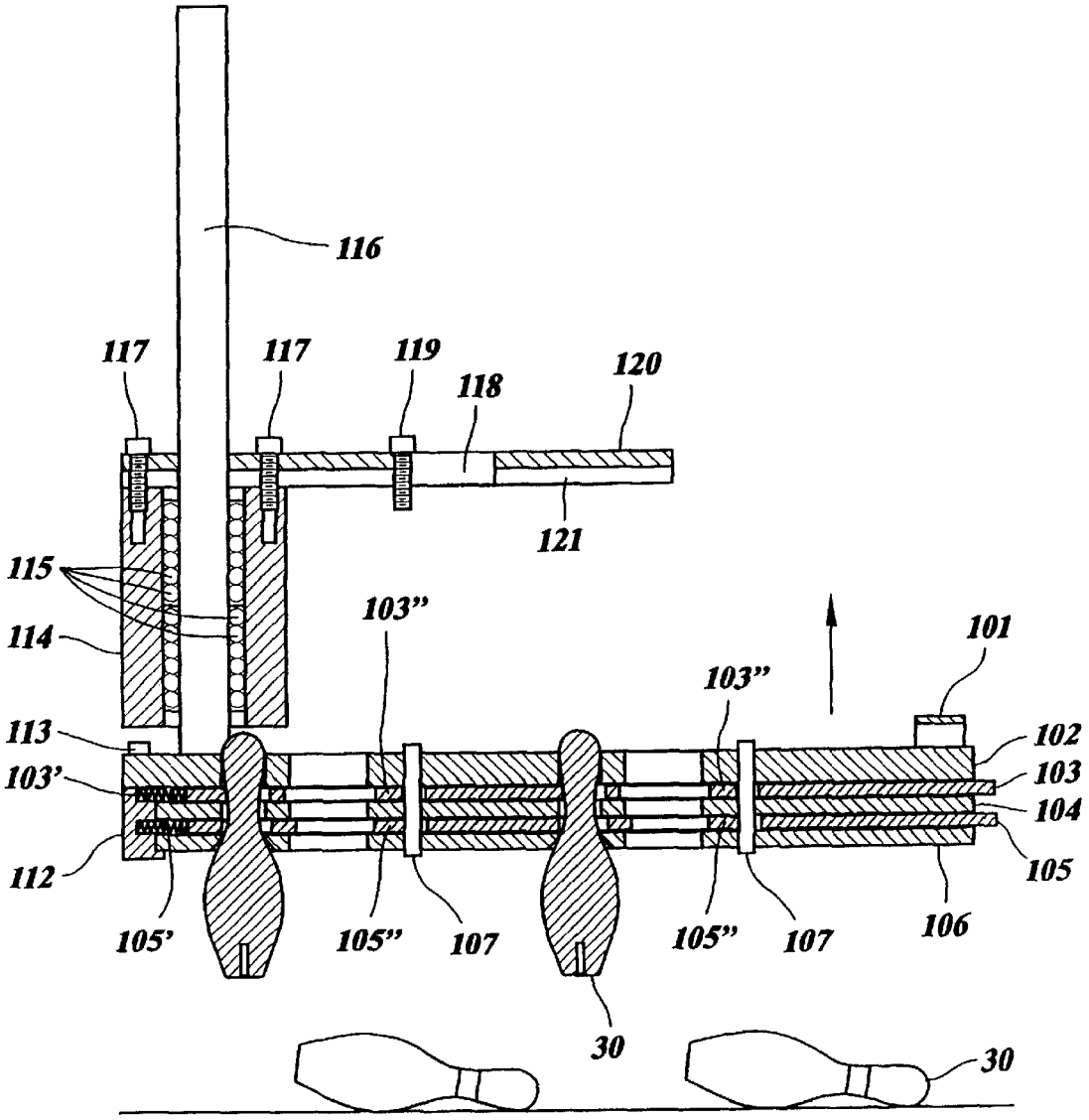

FIG. 9*a* shows part of the pins lying down and part still upright with the resetter in the up position and the top slide plate moved to spare position. FIG. 9*b* shows the re-setter lowered to collect the standing pins. FIG. 9*c* shows standing pins raised so that the fallen pins can be swept away by the sweep 31 as clearly shown in FIG. 7*c*. The upright pins are held in place in the re-setter by spare release plate 103.

Figure 9D:
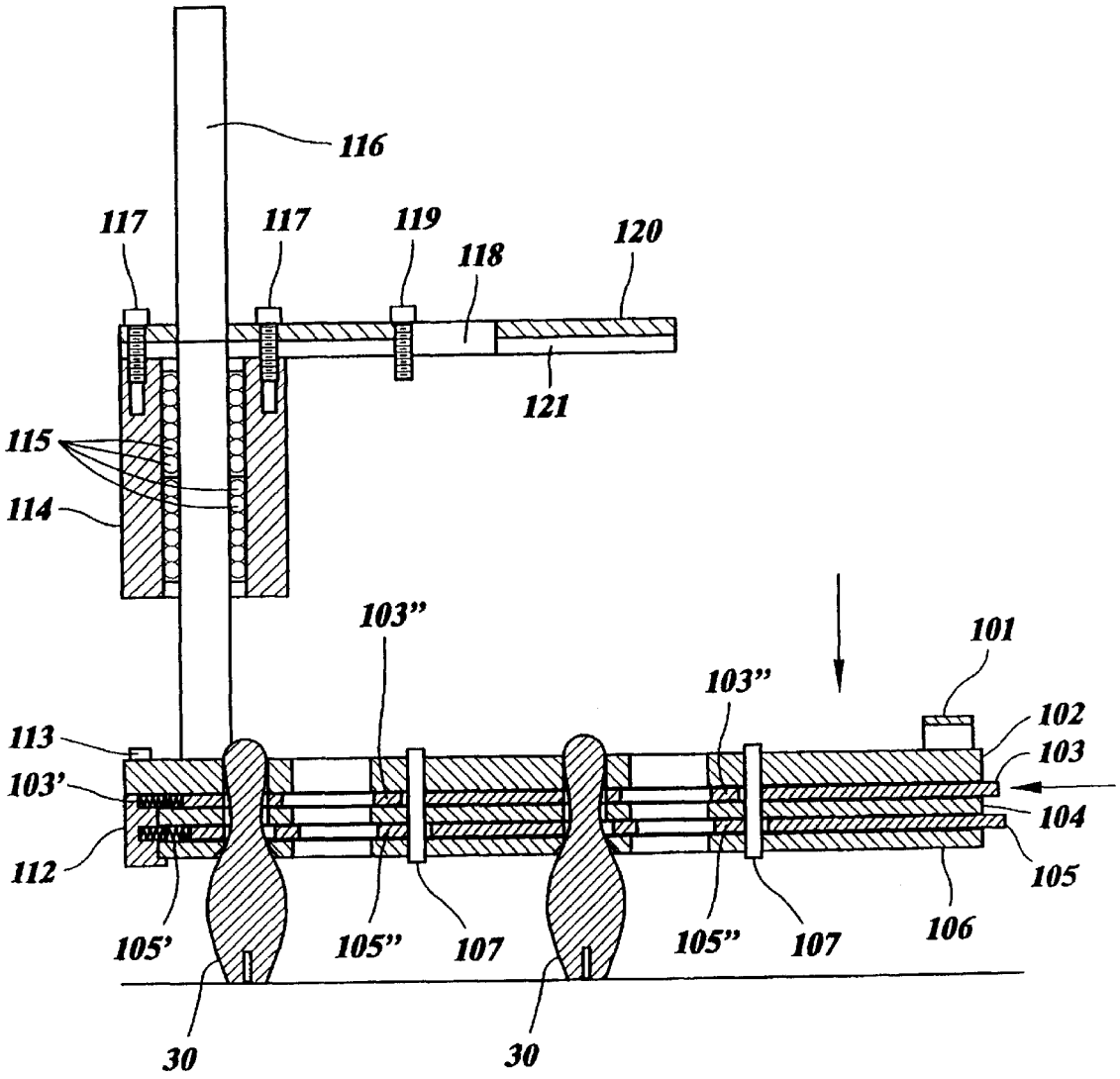
Figure 9E:
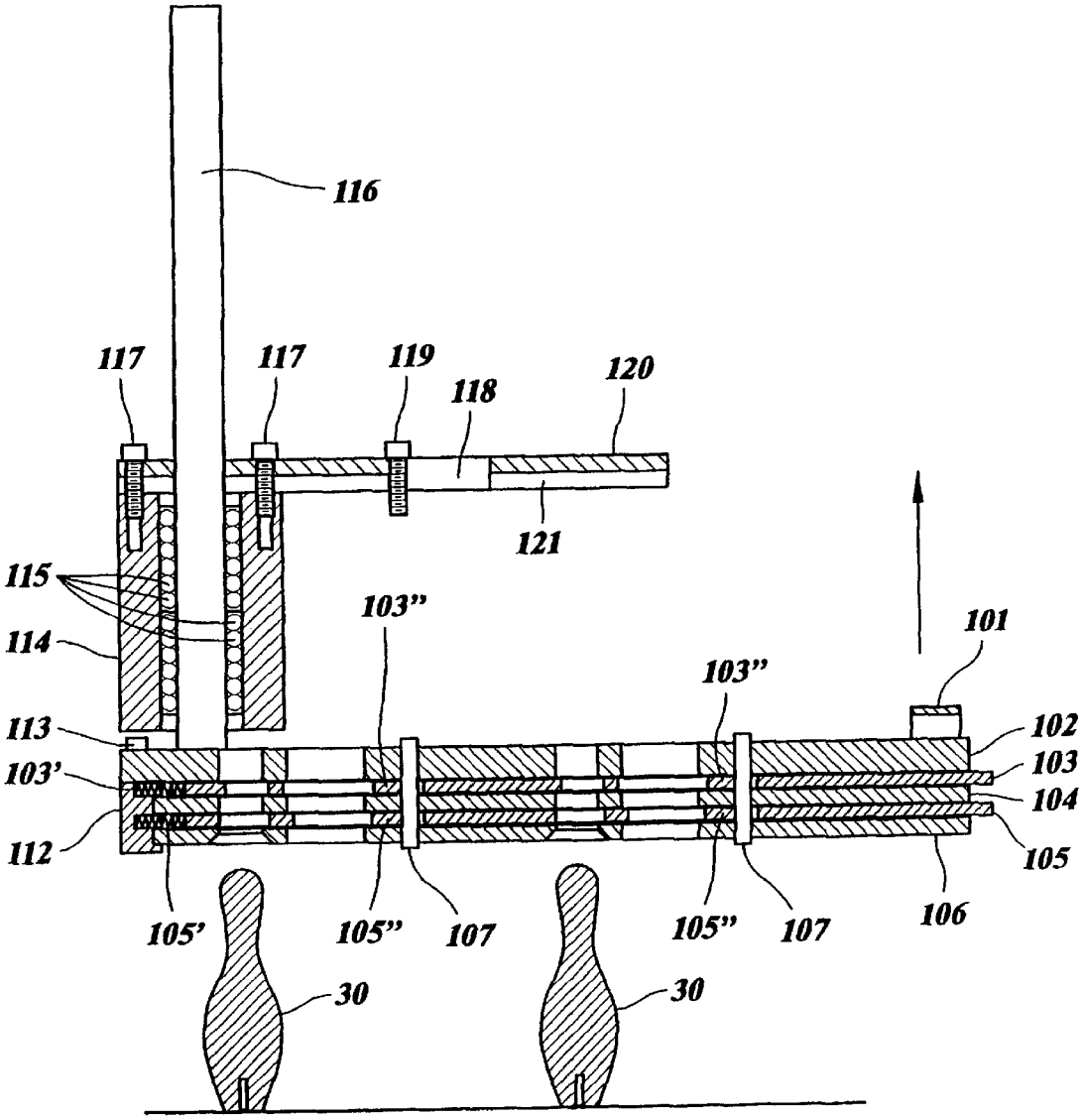

FIG. 9*d* shows the re-setter lowered with the spare plate pushed to release the standing pin on their respective pin location dots 26. FIG. 9*e* shows the standing pins in position on the lane 14 with the re-setter being raised.

The billiard bowling game resetting system 24 has been described as manually operated. It is to be understood, however, that a miniature automatic pin setting system of the type used in bowling alleys could be incorporated to the present invention. Also, miniature automatic scoring systems that are used in bowling alleys could be incorporated into the present invention. Since automatic pin setting systems and automatic scoring systems are well known to those skilled in the art, further detailed discussion of the same is not deemed necessary.

From the above, it can be seen that the present invention provides a reduced size bowling game that uses billiard balls shot with billiard cues and includes means for resetting the pins and returning the balls. The game is scored in the same manner as conventional bowling with the same sounds being made. The skills and thrills of both billiards and bowling are required and encountered during play of the billiard bowling game.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A miniature billiard bowling game, comprising: a support member including elevating means for carrying said support member above floor level; a first lane assembly horizontally carried on said support member including an elongated rectangular planar sheet replicating a bowling lane of reduced scale, said sheet having location indicia at the rear end thereof, said indicia replicating the orientation of a set group of bowling pins of said reduced scale; recessed grooves at the sides of said sheet replicating a gutter of said reduced scale; a planar access area at a front end of said sheet, said access area being horizontally parallel to and vertically raised above said sheet; miniature bowling pins of said reduced scale for placement on said indicia; a billiard ball; and billiard cue means for impacting said billiard ball, whereby when said billiard ball is shot with said billiard cue, said billiard ball becomes airborne prior to landing on said first lane assembly to create a sound that simulates a bowling ball landing on its respective bowling lane.

2. The miniature bowling lane as recited in claim 1 wherein said billiard ball includes a radial hole for causing said ball to curve during travel from said access area to said pins.

3. The miniature bowling lane as recited in claim 2 wherein a weight is carried in said radial hole.

4. The miniature bowling lane as recited in claim 1 wherein an enclosure surrounds said rear end of said sheet and includes vertically shiftable pin setting means for locating said pins on said indicia.

5. The miniature bowling lane as recited in claim 4 wherein said pin setting means includes gripping means for releasably carrying said pins from a raised position above said rear end to a pin setting position placing said pins on said indicia.

6. The miniature bowling lane as recited in claim 5 wherein said pin setting means includes a handle for manually moving said pin setting means between said raised position and said pin setting position.

7. The miniature bowling lane as recited in claim 6 wherein said enclosure carries horizontally shiftable pin sweeping means for moving pins from said indicia beyond said rear end to a pin receptacle located behind and below said rear end of said sheet.

8. The miniature bowling lane as recited in claim 7 wherein said pin sweeping means includes a handle projecting above said enclosure for moving said pins.

9. The miniature bowling lane as recited in claim 8 including gravitation ball return means adjacent said gutter for manually returning said billiard ball from said pin receptacle to said access area.

10. The miniature bowling lane as recited in claim 9 wherein a portion of said ball return means extends beneath said planar sheet.

11. The miniature bowling lane as recited in claim 10 including a second lane assembly carried by said support member is laterally spaced from said first lane assembly by one of said gutters and said ball return means.

* * * * *